US005184357A

United States Patent [19]

Last

[11] Patent Number: 5,184,357

[45] Date of Patent: Feb. 9, 1993

[54] AUTOMATIC SWIMMING POOL COVER WITH A DUAL HYDRAULIC DRIVE SYSTEM

[76] Inventor: Harry J. Last, 1246 Birchwood Dr., Sunnyvale, Calif. 94089

[21] Appl. No.: 741,480

[22] PCT Filed: Jul. 24, 1990

[86] PCT No.: PCT/US90/04157

§ 371 Date: Nov. 28, 1991

§ 102(e) Date: Nov. 28, 1991

Related U.S. Application Data

[63] Continuation-in-part of Ser. No. 494,564, Mar. 16, 1990, Pat. No. 5,067,184, which is a continuation-in-part of Ser. No. 258,000, Oct. 17, 1988, Pat. No. 4,939,798.

[51] Int. Cl.[5] ..... E04H 4/10

[52] U.S. Cl. ..... 4/502

[58] Field of Search ..... 4/502; 242/75.53, 86.52

[56] References Cited

U.S. PATENT DOCUMENTS

| | | | |
|---|---|---|---|
| 4,544,070 | 10/1985 | Sickler | 242/75.53 X |
| 4,565,334 | 1/1986 | Ruhl | 242/75.53 X |
| 4,939,798 | 7/1990 | Last | 4/502 |
| 4,955,092 | 9/1990 | Hagan | 4/502 |
| 5,067,184 | 11/1991 | Last | 4/502 |

*Primary Examiner*—Charles E. Phillips
*Attorney, Agent, or Firm*—David E. Newhouse

[57] ABSTRACT

A hydraulic drive system is described for automatic swimming pool cover systems in which a first hydraulic drive provides torque for both resisting cover drum rotation during cover extension across the pool and rotating the cover drum for cover retraction, while a separate second hydraulic drive provides torque for both rotating the cable reels for cover extension and resisting cable reel rotation during cover retraction.

6 Claims, 2 Drawing Sheets

AUTOMATIC SWIMMING POOL COVER WITH A DUAL HYDRAULIC DRIVE SYSTEM

Related Applications

This application is a continuation-in-part of application Ser. No. 07/494,564 filed Mar. 16, 1990, now U.S. Pat. No. 5,067,184 in the United States of America by the applicant, Harry J. Last, entitled "A COVER DRUM HAVING TAPERED ENDS FOR AN AUTOMATIC SWIMMING POOL COVER" which is a continuation-in-part of Ser. No. 07/258,000, filed Oct. 17, 1988, now U.S. Pat. No. 4,939,798 issued Jul. 10, 1990 to applicant, Harry J. Last, entitled: "LEADING EDGE AND TRACK SLIDER SYSTEM FOR AN AUTOMATIC SWIMMING POOL COVER".

BACKGROUND OF THE INVENTION

1. Field of the Invention

The invention relates to automatic swimming pool cover systems, and in particular, to the drive systems for rotating the cable reels and cover drum for extending and retracting pool covers back an forth across a swimming pool.

2. Description of the Prior Art

Automatic swimming pool cover systems typically include a flexible vinyl fabric sized so that most of it floats on the surface of the pool water. The pool water acts as a low friction surface significantly reducing the amount of force required to move the cover across the pool. The front edge of the cover is secured to a rigid boom spanning the width of the pool for holding the front edge of the cover above the water as it is drawn back and forth across the pool.

To draw the cover across the pool, a cable, typically a Dacron line, is incorporated into and forms a beaded tape which is sewn or attached to the side edges of the pool cover. The beaded tape in turn is captured and slides within a "C" channel of an extruded aluminum track. The track is secured either to the pool deck or the the underside of an overhanging coping along the sides of the swimming pool. The cables extending from the beaded tape sections of the cover are trained around pulleys at the distal ends of the tracks and return in a parallel "C" channel to the drive mechanism where they wind around cable take-up reels.

To uncover the pool, the drive mechanism rotates a cover drum mounted at one end of the pool winding the pool cover around its periphery and unwinding the cables from around the take-up reels. To cover the pool the drive mechanism rotatably drives the cable take-up reels winding up the cables to pull the cover across the pool unwinding the cover from around the cover drum.

The rate at which the pool cover unwinds from and winds onto the cover drum varies depending on the diameter of the roll of the cover still wound around the drum, i.e., the rate is greatest when most of the cover is wound around the drum (largest diameter) and least when the cover is practically unwound from the drum (least diameter). The same phenomenon occurs as the cables wind onto and unwind from the cable reels. It should be appreciated that the cables wind onto the cable reels at the highest rate when the cover unwinds from the cover drum at its lowest rate and visa-versa.

In systems where the cable take-up reels and the cover drum rotate together on the same axle, but oppositely wind/unwind the cables and cover respectively, a spring is utilized as a tensioning take-up mechanism to compensate for the different and varying rates at which the cables and pool cover wind and unwind from the respective reels and drum during the opening and closing cycles. The spring mechanism lengthens and shortens the cable path as the cover is drawn back and forth across the pool taking up and yielding slack in the respective cables as necessary to compensate for the differences in the winding and unwinding rates of the reels and drum. [See U.S. Pat. Nos. 3,747,132 and 3,982,286, Foster.]

In spring tensioning take-up systems of the type described by Foster, and later floating spring tensioning take-up systems of the type pioneered by Last, the applicant herein, the tesioning of the cables by the spring(s) assures that the cover, and especially its beaded edges curling around the ends of the drum, wind tightly and uniformly without substantial bias around the cover drum as the cover is retracted from across the pool. However, there is an upper limit beyond which the tensioning/compensating spring of such single axle systems can not compensate for the differential in winding rates of the cover and cables. [See U.S. Pat. No. 3,982,286, Foster, Col. 5, 1. 36–Col. 6, 1. 4. See also related U.S. Pat. No. 4,939,798.]

In other systems, a clutching mechanism is typically utilized to decouple the rotation of the cable reels from that of the cover drum as it is rotatably driven to wind the cover onto the drum uncovering the pool, and to decouple the rotation of the cover drum from that of the cable reels as they are rotatably driven to draw the cover across the pool. Typically, in such systems, the cable reels are allowed to free wheel when the cover drum is rotatably driven and conversely, the cover drum to free wheel when the cable reels are rotatably driven. [See U.S. Pat. Nos. 3,019,450 and 3,050,743, Lamb.]

In clutch decoupled systems of the type pioneered by Lamb, in order to prevent biasing of the cover as it winds around the cover drum during retraction and to assure that the cover winds compactly and uniformly around the drum, adjustable braking mechanisms are utilized to slow or resist rotation of the respective free wheeling take-up reels to provide the necessary tension in the cables for assuring that cover edges curl around the ends of the cover drum. Such braking mechanisms typically are adjustable for each take-up reel.

In early automatic pool cover systems the rigid boom spanning the width of the pool holding the front edge of the cover above the water was typically supported by a pair of wheeled dollies rolling on the side edges of the pool. The cables moving within the "C" channels of the track along either side of the pool were either directly secured in some fashion to the rigid boom, [Foster, supra], or were indirectly secured to the ends of the boom via fabric interfaces referred to as gores. [See U.S. Pat. No. 4,001,900, Lamb].

Slider mechanisms have supplanted the use of wheeled dollies for supporting the rigid boom carrying the front edge of the cover. Typically, such slider mechanisms are coupled to the respective ends of the boom and have an edge adapted for capture and sliding within the same or different "C" channels of the extruded track in which the beaded side edge of the cover is captured and slides. [See U.S. Pat. No. 4,686,717, MacDonald et al and U.K. Patent No. 2,072,006, Lee.]

As pointed out and extensively discussed in Applicant's related U.S. Pat. No. 4,939,798, in systems where slider mechanisms support the rigid boom, it is very important to maintain the boom oriented squarely between the track channels, otherwise the sliders carrying the boom will jam in the track channels stopping extension or retraction of the cover. Even with wheel supported booms, any canting during extension or retraction will tend to pull the beaded cover edge free of the confining track channels particularly at its front corners.

SUMMARY OF THE INVENTION

The invented hydraulic drive for swimming pool covers systems includes a first reversible hydraulic motor mechanically coupled for rotating cable reels around which the cables, extending from beaded side edges of a pool cover, wind and unwind, a second reversible hydraulic motor mechanically coupled for rotating a cover drum around which the pool cover winds and unwinds, a source of hydraulic power, and a control means hydraulically coupling the respective motors to the source of hydraulic power for: (i) providing a driving torque, via the first motor, for rotating the cable reels winding up the cables while simultaneously providing a resistive torque, via the second motor, resisting rotation of the cover drum as the cover unwinds and is drawn across covering the pool; and (ii) providing a driving torque, via the second motor to wind the cover around the cover drum retracting it from across uncovering the pool, while simultaneously providing a resisting torque, via the first motor, resisting rotation of the cable reels to tension the cables and cover as the cover retracts and winds around the cover drum.

In particular, the respective reversible hydraulic motors each function as both a motor and a pump and are mechanically coupled by the interconnecting cables and cover winding and unwinding from around the respective cable reels and cover drum such that when one motor is hydraulically driven to provide torque, the other motor hydraulically responds as a pump. The hydraulic exhaust from the driving motor provides hydraulic input for the pumping motor. The control means includes at least a two position hydraulic valve for reversing flow of hydraulic liquid from the source of hydraulic power through the respective motors/pumps.

A particular novel and advantageous feature of the invented hydraulic drive system is that limit switches for interrupting cover extension/retraction can be eliminated by appropriate adjustment of input and output pressure relief valves which limit the driving torque available for rotating the cable reels and the cover drum during cover extension and retraction, respectively, such that an increase in torque load above a threshold value stops extension/retraction.

Another advantage of the invented drive system is that a tension load on the cover and cables can be established and then maintained relatively constant as the cover extends and retracts, as well as when the cover is at rest, in the fully extended and retracted positions, in contrast, to spring tensioned, single axle systems in which tension increases and decreases as the cover extends and retracts back and forth across the pool, and in contrast to clutch de-coupled systems in which can not maintained tension on the fully extended and/or retracted cover.

Accordingly, a particular object of the invented drive system is control over the tension in the cables and cover during cover extension and retraction achieved by increasing and decreasing pressure in the output line from the motor functioning as a pump using an adjustable pressure relief valve.

Still another advantage of the invented drive system is that the differential in winding/unwinding rates of the cover and cables do not impose an upper limit on the length of pool that can be covered and uncovered by the automatic cover system.

Other advantageous features of the invented drive system relates to elimination of electrical power hazards in the the pool environment in that electrically driven hydraulic power sources can be located remotely.

Another aspect of the invented drive system is that the cover drum disposed at one end of the pool can be located in a trench flooded with pool water to provide buoyant support to the cover drum and cover drum roll for counterbalancing bending moments on the cover drum due to the weight of the cover wound around it.

Still other features, aspects, advantages and objects presented and accomplished by the invented hydraulic drive system for automatic swimming pool covers will become apparent and/or be more fully understood with reference to the following description and detailed drawings of preferred and exemplary embodiments.

DESCRIPTION OF PREFERRED AND EXEMPLARY EMBODIMENTS

Figure 1:
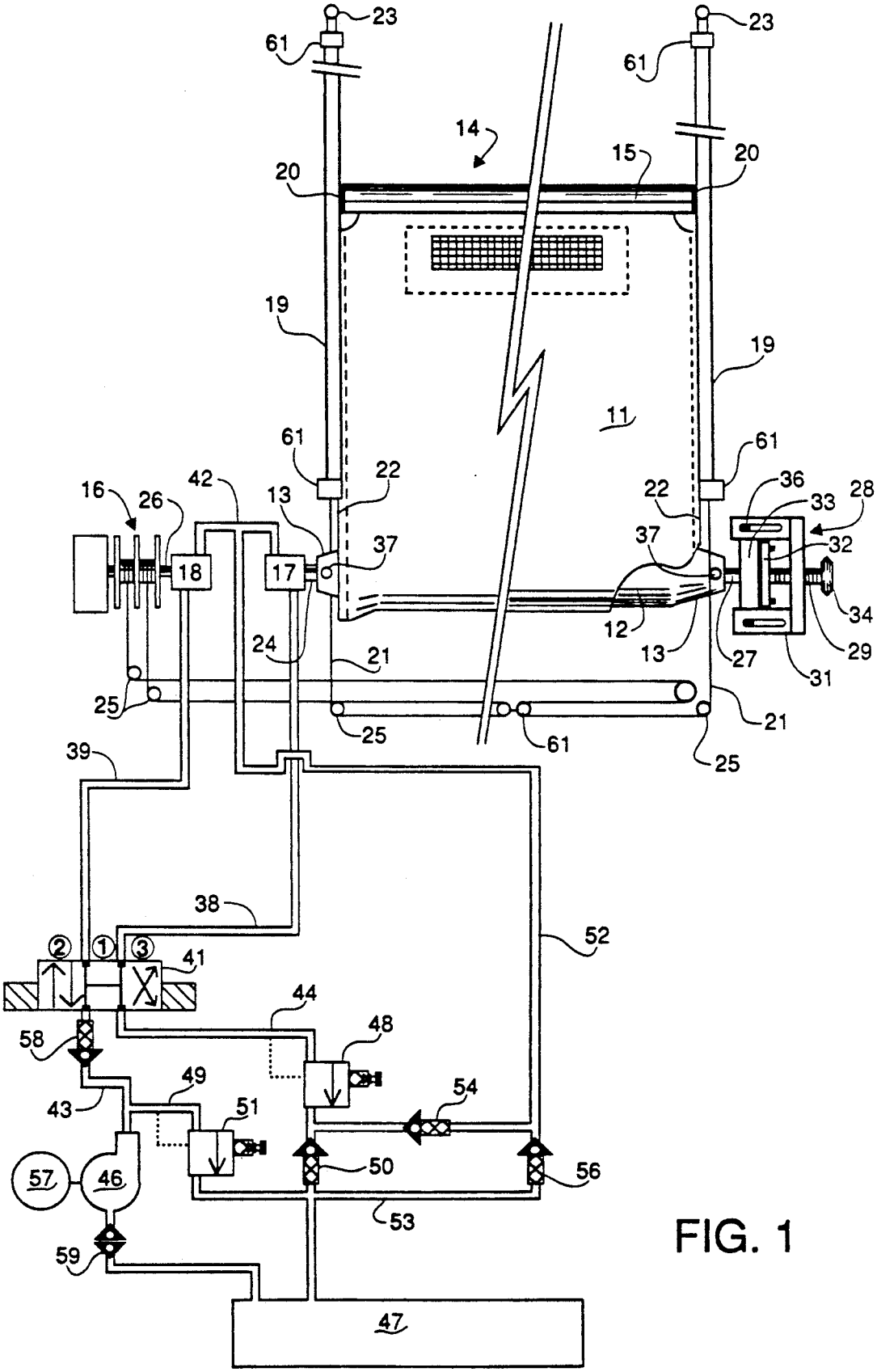
FIG. 1 is a top plan schematic view of an automatic swimming pool cover system incorporating and illustrating the essential components of the invented dual hydraulic motor drive system.

Referring to FIG. 1, a top plan view of an automatic pool cover system is shown which includes a leading edge and slider system of the type described in Applicant's U.S. Pat. No. 4,939,798, entitled "Leading Edge and Track Slider System for an Automatic Swimming Pool Cover" and with conically tapered hubs at either end of the cover drum as described in Applicant's copending U.S. application Ser. No. 07/494,564, entitled, "A COVER DRUM HAVING TAPERED ENDS FOR AN AUTOMATIC SWIMMING POOL COVER."

As shown in FIG. 1, a flexible vinyl fabric pool cover 11, is attached for winding around a cylindrical cover drum 12 with conically tapering end sections or hubs 13 supported for rotation at the end of a swimming pool (not shown). The front edge 14 of the cover 11 is supported by a rigid leading edge 15 spanning the width of the pool above the water between conventional parallel "C" channel swimming pool tracks 19 secured along the sides of the swimming pool. Sliders 20 coupled at each end of the rigid leading edge are fastened to cables 21. The sliders 20 are captured and slide within the "C" channels of the respective tracks 19. [See U.S. Pat. No. 4,939,798.]

The cables 21, typically Dacron lines, are incorporated into and form a beaded tape 22 sewn to the side edges of the cover 11. The cables 21 extend from the front corners of the cover 11, are trained around pulleys 23 at the distal ends of the tracks 19, and return via return internal "C" channels within the track 19 to ultimately connect with and wind onto a pair of cable take-up reels 16. Return pulleys 25 provide the necessary changes of direction between the return channels of the tracks 19 and the cable reels 16. The beaded tapes 22 sewn to the side edges of the cover 11 are captured and slide within the conventional "C" channels within the respective tracks 19.

A floating pair of coupled pulleys 61 are incorporated into the respective cable paths 62 between the take-up reels 16 and tracks 21 to compensate for differences in the rates at which the cables 21 wind around the respective cable take-up reels 16 during cover extension. In particular, the diameter of the cables winding around the respective take-up reels 16 frequently differ, depending on the distribution of the cable coil layers around the reel. More cable 21 is wound around the reel 16 of the larger diameter than the smaller in a single rotation, a fact which could cause the boom 15 to skew and jam between the "C" channels of the track 21.

The couple pulleys 61 translate toward the larger diameter take-up reel 16 lengthening the cable path for the cable 21 being wound around the smaller diameter take-up reel 16 thereby counter balancing or compensating for the difference in cable lengths being wound around the respective take-up reels in any single rotation. The coupled pulleys also equalize the tension in the respective cable paths.

A tension spring coupling between the pulleys will further improve performance the coupled pair of pulleys 61 in the manner previously described in context of the automatic pool cover systems utilizing floating spring tensioning take-up mechanisms. (See U.S. Pat. No. 4,939,798.) To explain, the maximum tension load on the respective cable paths occurs upon initiation of the extension cycle. The drive mechanism, via the cables, must overcome the inertial resistance of the cover drum with a fully wound up cover in addition to the frictional resistance of the sliders and beaded tape edges in the "C" channels of the track 19. Accordingly, upon initiating cover extension, the respective cable paths experience shock loading. Such shock loading can cause mechanical and fatigue failures. Incorporating a tensioning spring between the coupled pair of pulleys 61 provides necessary resiliency in the cable paths to prevent such shock loading, and at the same time, provides a mechanism for increasing tension load on the cable paths to overcome the initial inertial resistance of the fully loaded cover drum.

The cover drum 12 is supported for rotation between the respective tracks 19, within a trench located at one end of the pool (FIG. 2) by a translating bearing block 28 and a bearing block (not shown) receiving and supporting axles 24 and 27 coaxially extending from the conical hubs 13 at either end of the cover drum 12. Additional bearing blocks can be journaled around to the respective supporting axles 24 and 27 to provide additional capacity (and/or rigidity) for mechanical supporting the cover drum 12. However, care should be exercised in locating such additional bearing blocks to insure a desired range of axial translation of the cover drum drive train.

The cover drum drive train including the conical hubs 13 and axles 24 and 27 can be translated along the longitudinal rotational axis of the cover drum 12 utilizing the translation bearing block 28. In particular, the bearing block 28 includes a helically threaded shaft 29 threaded through the rear wall of a rigid hexahedral frame 31. The end of the shaft 29 is mechanically coupled by a conventional non-rotating collar 32 to a translating frame 33 supporting a bearing receiving the axle 27. An adjustment knob or crank 34 is mechanically fastened to the opposite end of the shaft 29 extending out of the hexahedral frame 31.

To adjust the position of the cover drum drive train between the parallel tracks 19, the tension on the cover 11, and its associated beaded side edges 22 and cables 21 is relieved, typically, by releasing a ratcheting mechanism (not shown) allowing the cable reels 16 to free wheel on the reel axle 26. The bolts 36 securing the bearing frame 33 within the hexahederal frame 31 of the translating bearing block 28 are loosened sufficiently to allow translation of the cover drum drive train. Shaft 29 is rotated with crank 34 by hand to translate the cover drum drive train to a new position. The bolts 36 are then re-tightened and the cover and cables re-tensioned by re-engaging the ratchet mechanism and turning either the cover drum 12 or cable reels 16. Diametric holes 37 located near the apex of the conical hubs 13 adapted to receive a longitudinal bar or crank (not shown) for manually turning the cover drum 12 can be utilized for re-tensioning the system.

As shown in FIG. 1, a first reversible hydraulic motor 17 is mechanically keyed to for rotating the end of axle 24 extending from the cover drum 12. A second reversible hydraulic motor 18 is mechanically keyed to for rotating axle 26 and the cable reels 16. Hydraulic lines 38 and 39 connect between the respective motors 17 and 18 and a three position solenoid valve 41. Hydraulic line 42 connects between the motors 17 and 18. High pressure hydraulic input line 43 connects between a pump 46 and the solenoid valve 41. Exhaust hydraulic line 44 connects between the solenoid valve 41 and the hydralic fluid reservoir 47 via an adjustable pressure relief valve 48 and an anti-cavitation check valve 50. Bypass hydraulic line 49 connects between the high pressure input line 43 and the reservoir 47 via a second adjustable pressure relief valve 51. An anti-cavitation hydraulic line 52 connects between the hydraulic line 42 coupling the motors 17 and 18 and the exhaust line 44 between pressure relief valve 48 and the anti-cavitation check valve 50. Overflow hydraulic line 53 connects between the anti-cavitation line 52 and the reservoir 47. Low pressure check valves 54 and 56 are placed in the anti-cavitation and overflow hydraulic lines 52 and 53 to assure hydraulic liquid flow through the anti-cavitation line 52 to the motors 17 and 18 via line 42. The hydraulic pump is driven by an electrical motor 57. A check valve 58 in high pressure line 43 prevents the hydraulic liquid from draining into the tank 47 when the pump 46 is off. A filter 59 is located between the pump 46 and reservoir tank 47.

The three position solenoid valve 41 is "normally closed" at position 1 (as shown in FIG. 1) meaning that valve 41 does not allow hydraulic liquid flow to or from either of the motors 17 and 18 when not energized, and hydraulic liquid circulates via the bypass line 49 between the pump 46 and tank 47. When energized for extending the cover 11, the solenoid valve 41 (at position 2) directs the high pressure hydraulic liquid from input line 43 to the hydraulic motor 18 coupled to the cable reels 16 and exhaust liquid from motor 17 coupled to the cover drum 12 to exhaust line 44. When energized for retracting the cover 11, the solenoid valve 41 (at position 3) directs the high pressure hydraulic liquid from input line 43 to the hydraulic motor 17 coupled to the cover drum 12 and exhaust liquid from motor 18 coupled to the cable reels 16 to exhaust line 44.

The cover 11 winding and unwinding from around the cover drum 12 and the cables winding and unwinding from around the cable reels 16 provide a mechanical connection between the respective motors 17 and 18. In particular, when motor 17 is driven by the hydraulic liquid for rotating the cover drum, motor 18 coupled to the cable reels is rotatably driven as a pump. Similarly, when motor 18 is driven by the hydraulic liquid for rotating the cable reels 16, motor 17 coupled to the cover drum 12 is rotatably driven as a pump.

The torque provided to the driving motor must be sufficient to overcome both the inherent friction of the mechanical components of the pool cover system as well as the tension load imposed on the system by the pumping motor. It should be appreciated that the torque resistance which must be overcome by the driving motor increases with the "winding radius" of cover drum 12 or cable reels 16, and that tension load imposed on the system by the pumping motor also increases as the the "unwinding radius" of the cover 11 around the cover drum 1 or cables 21 around cables reels 16 decreases. The terms "winding radius" and "unwinding radius" refer respectively to the increases and decreases in radius due to layers of cover 11 being wound and unwound from around the drum 12, in the case of the cover drum, and to the layers of cable coils being wound and unwound from around the reels 16, in the case of the cover reels.

Sources of friction inherent in a pool cover system include both constant sources, and variable sources. The constant sources of friction are those which do not vary as the cover extends and/or retracts, e.g. the friction of pulley system directing the cables 21 and the bearings supporting turning axles, the cables moving in the return channels of the tracks 19 and the friction of the sliders supporting the leading edge 15 sliding within the "C" channels of the tracks 19. Variable friction sources are those that vary with the degree of extension/retraction of the cover, e.g., the friction due to the beaded tape edges 22 of the cover 11 sliding within the "C" channels of the tracks 19 will increase as the cover 11 extends across the pool and will decrease as the cover retracts.

From the above analysis, it should be appreciated that the tension load imposed on the system by the pumping motor opposing the driving torque of the driving motor approaches a maximum as the leading edge 15 of the cover 11 reaches the end points of its travel at either end of the pool. The resistance torque due to friction is at a maximum when the cover is fully extended.

Adjustable pressure relief valve 48 on the exhaust line 44 establishes the exhaust pressure against which the pumping motor pumps, hence the tension load or resistance imposed on the system by the pumping motor. Adjustable pressure relief valve 51 in the bypass line 49 establishes the pressure of the hydraulic liquid from the pump 46 and, hence, the torque available to the driving motor for rotating either the cover drum 12 or the cable reels 16. By appropriate adjustment of the respective pressure relief valves 48 and 49, it is possible to counterbalance the driving torque of the driving motor with the tension load imposed by the pumping motor for slowing and even effectively stopping extension/retraction of the cover 11 as its leading edge 15 approaches its end points of travel.

In practice, however, to assure complete extension and retraction of the cover 11, the differential pressure of the driving and exhaust hydraulic liquids should always be adjusted such that the driving torque winding the cables or cover will just exceed the maximum resistive torque. Stops 61 located at the respective ends of the pool stop movement of the leading edge 15 are utilized to increase the tension load sufficiently for counter-balancing the torque of the driving motor. Such stops need only be able to mechanically withstand the differential load of the driving motor and the opposing tension load imposed by the pumping motor. (Such stops are inherent in under track pool cover systems comprising the copings at the respective ends of the pool which mechanically stop movement of the rigid leading edge 15.)

The differences between operational loads experienced during extension and those experienced during retraction caused by, for example, the increase/decrease of friction as a function of cover extension are compensated through appropriate adjustment of the initial winding/unwinding radius of the cables 21 (and/or cover 11). For example, the operational effect of increasing/decreasing friction during cover extension/retraction can be offset by decreasing the initial winding radius of the cable reels 16. In particular, since both the driving and resistive (pumping) torques of the motor 18 coupled to the cable reels remain constant, the increase in friction load as the cover extends is offset by increasing the available winding force obtained by the decrease in the cable winding radius. Similarly, the decreasing friction load on cover retraction is offset by an increase in tension load which again is obtained by decreasing the winding radius. And, it should be appreciated that the winding radius of the cover increases as the cover retracts causing the torque resisting windup to increase offsetting the decreasing component of resistance torque due to the decreasing friction of the beaded tape edges 22 sliding in the "C" channels of the tracks 19.

Also, as discussed in co-pending U.S. application Ser. No. 07/494,564 entitled "Cover Drum Having Tapered Ends For An Automatic Swimming Pool Cover," the winding/unwinding radius of the cover roll 65 around the cylindrical cover drum 12 can be manipulated or adjusted as the cover winds and unwinds by thickening sections of the cover with angularly oriented strips of a suitable material such as foam (not shown). The increase in cover thickness due to such strips increases the radius of the cover roll 65 (FIG. 2) as a function of the position of the leading edge 15 of the cover 12 relative to the cover drum 12. Such increases in the winding/unwinding radius effectively increases the torque resisting windup during retraction as the foam sections wind around the cover drum. And, on cover extension, since the unwinding radius is greater when such foam strips are still wound around the drum 12, less force (tension) is required in the cables and cover to cause the drum 12 and cover roll to unwind, i.e., less force (tension) is required for overcoming the torque resistance of the drum motor 17 acting as a pump. It is preferable to orient such thickening strips angularly with respect to the direction of travel of the cover such that the strips helically wind and unwind from around the drum to mitigate strain caused by differential stretching in the cover fabric in the affected transverse region of the cover over time.

Figure 2:
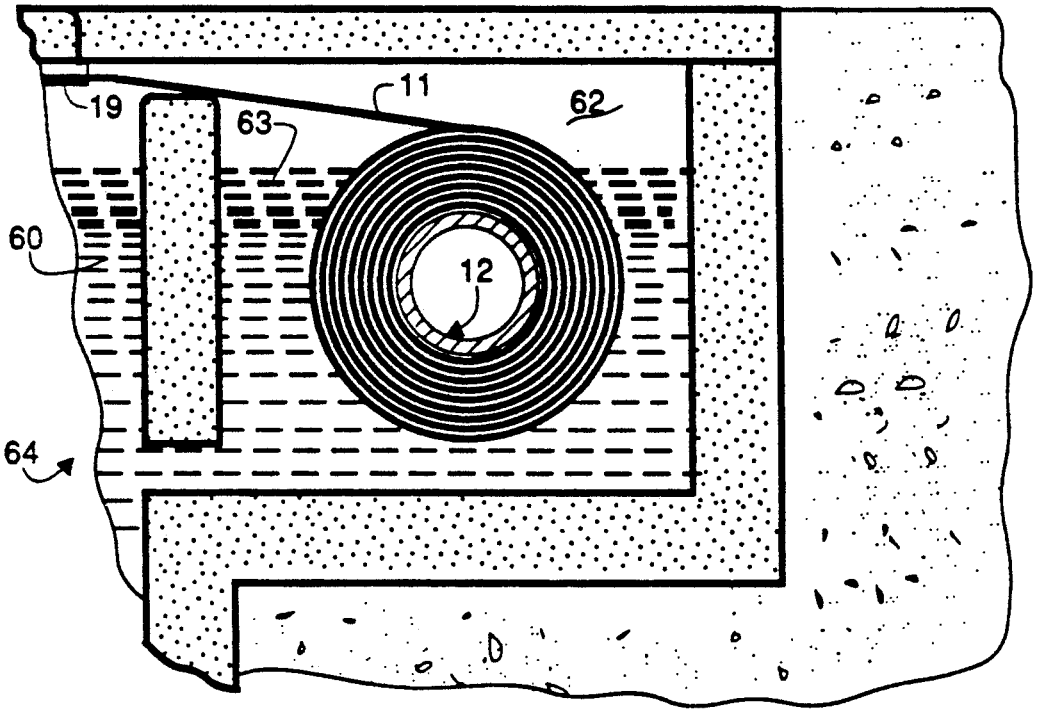
FIG. 2 is a side elevation schematic the cover drum with the pool cover wound around it disposed in a flooded trench illustrating the counterbalancing of the buoyancy forces and the bending moments on the drum.

Referring now to FIG. 2, because of the absence of electrical components in the pool environment, with the described hydraulic drive system, it is possible to flood the trench 62 in which the cover drum 12 is located at one end of the swimming pool 60 with pool water 63. A port 64 communicates from the bottom of the cover roll trench 62 into the swimming pool 60 to allow pool water 63 to flow in and out of the trench 62.

The buoyancy of the pool water 63 offsets the effect of gravity providing lateral support to the cover drum 12 as the cover 11 winds around it. In particular, for wide pools, the weight of the pool cover 11 winding around the cover drum 12 can cause the drum 12 to sag or bend in the center creating twisting or torque moments on the respective bearings supporting the drum 12 for rotation. Such twisting or torque moments, being perpendicular to the rotational axis of the cover drum drive train increase bearing friction and wear. In addition, excessive sag of the cover drum 12 inherently increases torque resisting windup in that the effective windup radius of the cover around the drum increases with increasing sag. Finally, utilizing the buoyancy afforded by the pool water to provide lateral support to the cover drum and cover winding around drum lessens mechanical rigidity and strength requirements for the components of the cover drum drive train with a resultant savings in materials costs and mass.

The invented dual hydraulic motor system for automatic swimming pool covers has been described in context of both representative and preferred embodiments. There are many modifications and variations can be made to the invented drive system which, while not exactly described herein, fall within the spirit and the scope of invention as described and set forth in the in the appended claims.

I claim:

1. A hydraulic drive system for extending and retracting swimming pool covers comprising, in combination, a first reversible hydraulic motor mechanically coupled for rotating at least one cable reel around which a pair of cables, extending from side edges of the pool cover, wind and unwind, a second reversible hydraulic motor mechanically coupled for rotating a cover drum around which the pool cover winds and unwinds, means coupling between the respective cables for equalizing tension in the respective cables and for compensating for any differential in rates at which the respective cables wind and unwind from around the cable reel, a source of hydraulic power, a control means hydraulically coupling the respective motors and the source of hydraulic power for:

(i) providing a driving torque, via the first motor, for rotating the cable reel to wind the cables around the reel while simultaneously providing a resistive torque, via the second motor, for resisting unwinding rotation of the cover drum as the cover unwinds and is drawn across covering the pool; and (ii) providing a driving torque, via the second motor for rotating the cover drum to wind the cover around the cover drum, while simultaneously providing a resistive torque, via the first motor, for resisting unwinding rotation of the cable reels to tension the cables and cover as the cover retracts uncovering the pool.

2. The hydraulic drive system for extending and retracting swimming pool covers of claim 1 wherein the first and second reversible hydraulic motors are each driven as a pump to provide the respective resistive torques to the unwinding rotation of the cable reel and cover drum respectively, the cables and cover mechanically coupling between the motor providing the driving torque (the driving motor) and the motor driven as a pump (the driven motor) providing the resistive torque.

3. The hydraulic drive system for extending and retracting swimming pool covers of claim 2 wherein the control means hydraulically coupling the respective motors and the source of hydraulic power includes:

a) a reservoir of hydraulic luiquid hydraulically coupled to the source of hydraulic power;

b) a common hydraulic line coupling between the respective reversible hydraulic motors such that output liquid from the motor providing driving torque is available as input liquid to the motor functioning as the pump providing the resisting torque;

c) a first input/output hydraulic line connected to the first reversible hydraulic motor;

d) a second input/output hydraulic line connected to the second reversible hydraulic motor;

e) a supply hydraulic line connected to the source of hydralic power;

f) an exhaust hydraulic line conneted to the reservoir of hydraulic liquid;

g) a valving means for hydraulically coupling the first input/output line to the supply line while simultaneously hydraulically coupling the second input/output line to the exhaust line, at a first position, and for hydraulically coupling the second input/output line to the supply line while simultaneously hydraulically coupling the first input/output line to the exhaust line, at a second position;

h) a bypass line hydraulically coupling between the supply line and the reservoir;

i) a high pressure adjustable pressure relief means in the bypass line for controlling hydraulic pressure in the supply line;

j) a low pressure adjustable pressure relief means in the exhaust line for controlling pressure in the exhaust line;

k) anti-cavitation means hydraulically coupling between the common hydraulic line and reservoir for assuring hydraulic liquid in the common hydraulic line.

4. The hydraulic drive system for extending and retracting swimming pool covers of claim 3 wherein the anti-cavitation means includes:

l) a first check valve means hydraulically coupled into the exhaust line between the low pressure adjustable pressure relief means and the reservoir for preventing fluid flow into the reservoir below pressure $P_1$;

m) a second check value means in a hydraulic line hydralically coupling between the common line and the exhaust line upstream from the first check valve means for preventing fluid flow to the common line below pressure $P_2$, where $P_1$ is greater than $P_2$; and n) a third check valve means in a hydraulic line hydraulically coupling the common line and the reservoir preventing fluid flow from the common line to the reservoir below pressure $P_2$, whereby a supply of hydraulic liquid supply in the common line for the driven motor is assured.

5. The hydraulic drive system for extending and retracting swimming pool covers of claim 1 wherein the cover drum is immersed in pool water at one end of a pool for providing lateral buoyant support to the cover drum and cover winding and unwinding from around the cover drum.

6. The hydraulic drive system for extending and retracting swimming pool covers of claim of claim 5 wherein the cover drum and second reversible hydraulic motor coupled for rotating the drum are located within a trench at one end of the swimming pool and wherein at least one port communicates between the trench and the swimming pool for allowing pool water to circulate into and flood the trench.

* * * * *